United States Patent [19]

Smeggil

[11] Patent Number: 4,826,738

[45] Date of Patent: May 2, 1989

[54] OXIDATION AND CORROSION RESISTANT CHROMIA FORMING COATINGS

[75] Inventor: John G. Smeggil, Simsbury, Conn.

[73] Assignee: United Technologies Corporation, Hartford, Conn.

[21] Appl. No.: 70,459

[22] Filed: Jul. 7, 1987

[51] Int. Cl.[4] ..... B32B 15/01; C22C 19/05

[52] U.S. Cl. ..... 428/678; 420/442; 428/679

[58] Field of Search ..... 420/442; 428/678, 679; 416/241 R

[56] References Cited

U.S. PATENT DOCUMENTS

| | | | |
|---|---|---|---|
| 1,802,695 | 1/1925 | Bennett | 428/678 |
| 2,406,582 | 8/1946 | Bieber et al. | 75/82 |
| 3,211,549 | 10/1965 | Kusaka | 420/434 |
| 3,218,156 | 11/1965 | VanderSluis et al. | 75/49 |
| 3,303,531 | 2/1967 | Ogden | 420/442 |
| 3,338,733 | 8/1967 | Rowady | 428/680 |
| 3,784,374 | 1/1974 | Almand | 420/85 |
| 3,795,505 | 3/1974 | Corradini | 75/53 |
| 3,816,103 | 6/1974 | Link, Jr. et al. | 75/53 |
| 3,853,540 | 12/1974 | Schlatter et al. | 75/53 |
| 3,869,282 | 3/1975 | Curran et al. | 75/82 |
| 4,018,597 | 4/1977 | Staggers | 75/58 |
| 4,049,470 | 9/1977 | Burton | 148/3 |
| 4,084,960 | 4/1978 | Kay et al. | 75/58 |
| 4,161,400 | 7/1979 | Wilson et al. | 75/58 |
| 4,275,124 | 6/1981 | McComas et al. | 428/679 |
| 4,385,934 | 5/1983 | McGurty | 420/40 |
| 4,397,683 | 8/1983 | Kay et al. | 75/58 |
| 4,484,946 | 11/1984 | Ototani | 75/58 |
| 4,507,149 | 3/1985 | Kay et al. | 75/58 |
| 4,530,720 | 7/1985 | Moroishi et al. | 420/43 |
| 4,542,116 | 9/1985 | Bertolacini et al. | 502/65 |
| 4,578,113 | 3/1986 | Rana et al. | 420/84 |
| 4,721,540 | 1/1988 | Harris et al. | 148/404 |

FOREIGN PATENT DOCUMENTS

| | | | |
|---|---|---|---|
| 0056555 | 4/1984 | Japan | 420/442 |

OTHER PUBLICATIONS

J. G. Smeggil et al, "The Use of Ion Implantation Techniques to Study Protective Oxide Scale Adherence Effects", J. Vac. Sci. Technol. A, vol. 3, No. 6, Nov/-Dec. 1985, pp. 2569–2573.

J. G. Smeggil et al, "A Relationship between Indigenous Impurity Elements and Protective Oxide Scale Adherence Characteristics", Metallurgical Transactions A, vol. 17A, Jun. 1986, pp. 923–932.

Paul D. Merica et al, "The Malleability of Nickel", Transactions of the AIME, vol. 71, 1925, pp. 709–719.

Richard S. Cremisio et al, "Sulfur–Its Effects, Removal or Modification in Vacuum Melting", Third International Symposium on Electroslag and Other Special Melting Technology, Jun. 1971, Symposium Proceedings Part I, pp. 1–30.

D. P. Whittle et al, "Improvement in Properties: Additives in Oxidation Resistance", Philosophical Transactions of the Royal Society of London, Series A, vol. 295 (1980) pp. 309–329.

Y. Ikeda et al, "High Temperature Oxidation and Surface Segregation of Sulfur", Proceeedings of the Third Japan Inst. of Metals, vol. 24, 1983, pp. 207–214.

R. A. Mulford, "Grain Boundary Segregation in Ni and Binary Ni Alloys Doped with Sulfur", Metallurgical Transactions A, vol. 14A, May 1983, pp. 865–870.

A. W. Funkenbusch et al, "Reactive Element–Sulfur Interaction and Oxide Scale Adherence", Metallurgical Transactions A, vol. 16A, Jun. 1985, pp. 1164–1166.

*Primary Examiner*—L. Dewayne Rutledge
*Assistant Examiner*—David Schumaker
*Attorney, Agent, or Firm*—James M. Rashid

[57] ABSTRACT

The adherence of protective chromia (chromium oxide) scales on Ni-Cr coatings is substantially improved by limiting the amount of sulfur in the coating composition to below about 5 parts per million by weight. Volatilization of the chromium oxide scale is also reduced by controlling the sulfur content. The coatings of this invention have improved resistance to oxidation and hot corrosion degradation than the coatings of the prior art.

4 Claims, 2 Drawing Sheets

OXIDATION AND CORROSION RESISTANT CHROMIA FORMING COATINGS

TECHNICAL FIELD

This invention relates to coatings, and in particular, to coatings having a nickel-chromium composition.

BACKGROUND

Power generating machines such as gas and steam turbine engines are widely used throughout the world, both on land and at sea. These machines include those which provide electricity for residential as well as industrial uses, and for providing propulsion to naval vessels and aircraft.

Certain components used in the high temperature section of power generating turbines undergo hot corrosion and oxidation during service. Hot corrosion generally takes place at temperatures in the range of about 700°-930° C. (1,300°-1,700° F.), when certain compounds which deposit on the component surfaces melt. These compounds contain elements such as the alkalis and alkaline earths, vanadium, lead, sulfur and oxygen, which are present in the air and fuel consumed by the engine during operation. Oxidation takes place at temperatures both above and below those at which hot corrosion takes place, and in the absence of compounds of the type mentioned above. Oxidation degradation is normally less rapid than degradation produced by hot corrosion.

Hot corrosion and oxidation requires the operators of these turbines to expend large amounts of time and money in repairing or replacing damaged components. As a result, the industry has searched for materials which can provide resistance to such attack. One solution which has been used to date has been to apply coatings to the surface of the engine components.

Coatings which form oxide scales based on chromium, typically $Cr_2O_3$, are particularly effective in reducing the amount of hot corrosion which takes place during engine operation. They also provide protection against oxidation. Chromium-based oxide scales, while reducing the amount of corrosion and oxidation on turbine components, sometimes spall or exfoliate from the surface of the components. After a sufficient amount of spallation, the chromium oxide film can no longer reform because the activity of chromium is reduced below the required level. When chromium levels are depleted, less protective and faster forming oxides form. Sometimes the term "green rot" is used to describe this condition. Further, vaporization of the chromium oxide at elevated temperatures limits the use of Ni-Cr coatings.

In view of the need for chromium oxide forming coatings with better properties, researchers have sought to improve the scale adherence of chromia films and to increase the temperatures to which they may be used. This invention satisfies those needs.

SUMMARY OF THE INVENTION

According to this invention, the adherence of chromium oxide films formed on Ni-Cr coatings is improved by reducing the sulfur level in the coating to a level below about 5 parts per million by weight (ppmw). Preferably, the sulfur level is below about 2 ppmw.

It has been discovered that sulfur in the coating accelerates chromia scale exfoliation; reducing the level of sulfur to below about 2 ppmw has been shown to markedly improve the adherence of the scale and to reduce the amount of $Cr_2O_3$: vaporization. As a result, hot corrosion and oxidation of turbine engine components is reduced, as are engine maintenance costs.

The foregoing, and other objects, features and advantages of this invention will become more apparent from the following description of the preferred embodiment, and the accompanying drawings.

BEST MODE FOR CARRYING OUT THE INVENTION

Figure 1:
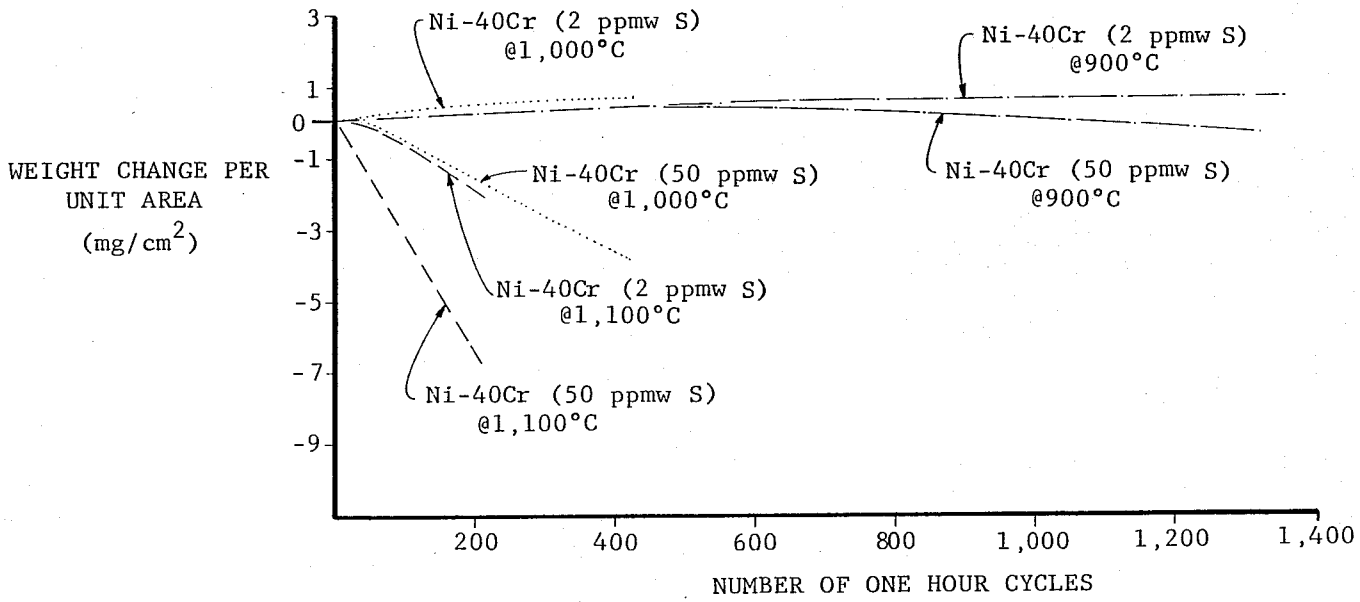
FIG. 1 is a graph showing the influence of sulfur on the oxidation resistance of a Ni-40Cr (weight percent) coating alloy.

The Ni-Cr coating alloys of this invention generally contain chromium in levels between about 0-50 weight percent, and small amounts of impurities. Preferably they contain between about 30-45 percent chromium. The most preferred chromium level is about 40 weight percent. To obtain the improved scale adherence of this invention, and therefore improved resistance to hot corrosion and oxidation, the sulfur level in the coating must be limited to below about 5 ppmw. Preferably, the sulfur is below about 2 ppmw. By limiting the amount of sulfur to these low levels, the chromium content in the coating can be as low as about 10%. Greater amounts of chromium have historically been required in Ni-Cr coatings, in response to the need for a large reservoir of chromium metal. Because chromium oxide scales which form on the coatings of this invention are more adherent and less volatile than those of prior art coatings, less chromium is needed to provide the requisite resistance to oxidation and hot corrosion.

Several techniques exist for applying the invention Ni-Cr coating alloys. They include chemical vapor deposition (CVD) such as pack or gas phase techniques, and physical vapor deposition (PVD) such as plasma spray and electron beam evaporation. The coatings are applied in thicknesses which range from about 25 microns to about 1,250 microns(1-50 mils). Preferably, the coating thickness is in the range of about 75 to 125 microns (3-5 mils). Regardless of the methods which are used to apply the coating, it is critical that the sulfur level be closely controlled. The primary method for controlling the sulfur level in the coating is to make the coating from very high purity nickel and chromium sources. Other measures, primarily dependent on the specific technique used to apply the coating, will be obvious to the skilled artisan.

Turbine components which are susceptible to hot corrosion attack, and which will benefit by application of the invention coatings, include those made from high temperature alloys based on iron, nickel, and cobalt. They can range from alloys such as conventional stainless steels, to refractory modified superalloys such as Inconel® Alloy 718 (Inco Alloys International), Rene 80 (see U.S. Pat. No. 3,615,376 to Ross), and PWA 1422 (see U.S. Pat. No. 3,711,337 to Sullivan).

Cyclic oxidation tests were conducted to evaluate the properties of low sulfur containing Ni-Cr coatings and to compare them with Ni-Cr coatings containing conventional levels of sulfur. Specimens were produced by vacuum melting and solidifying a Ni-40Cr composition in high purity aluminum oxide crucibles. Prior to testing, the specimens were homogenized at 1,200° C. (2,200° F.) for about 24 hours in an inert atmosphere. Cyclic oxidation tests were conducted at 900°, 1,000°, and 1,100° C. (1,650°, 1,830°, and 2,010° F.). Each cycle consisted of about 55 minutes at temperature followed by 5 minutes of forced air cooling. This type of cyclic oxidation test effectively demonstrates whether or not an oxide scale is adherent.

FIG. 1 shows that significant improvements in oxide scale adherence are observed when the sulfur level in the Ni-Cr coating is very low, about 2 ppmw. The benefits of low sulfur are most apparent at the 1,000° and 1,100° C. test conditions.

Figure 2A:
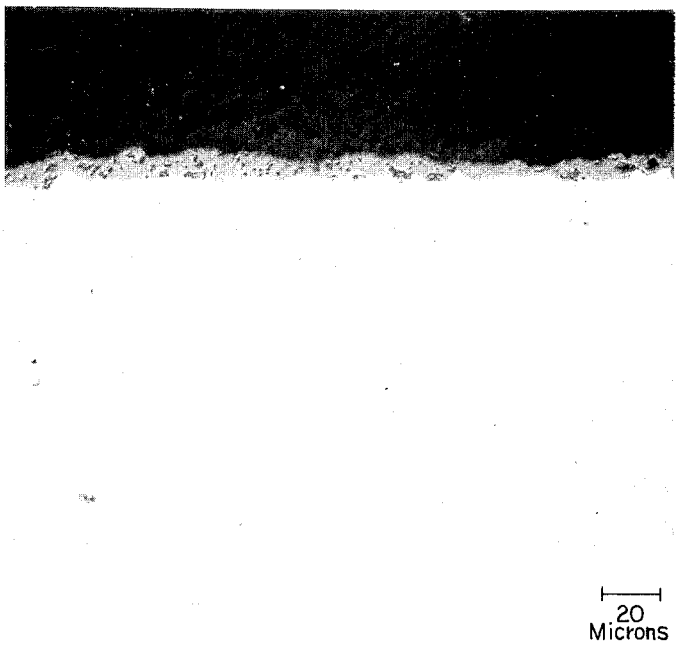
FIGS. 2*a* and 2*b* are photomicrographs showing the appearance of high purity and conventional purity Ni-40Cr coating alloys, respectively, after 410 cycles of oxidation testing at 1,000° C.
Figure 2B:
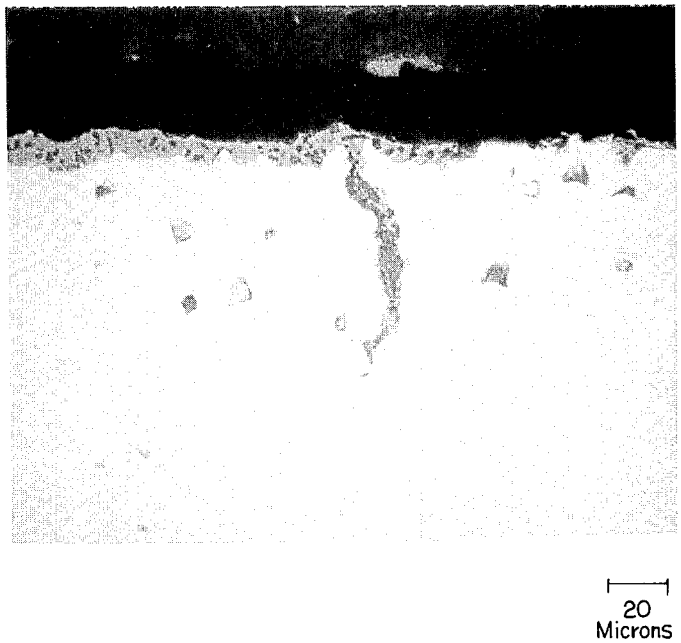

FIGS. 2*a* and 2*b* show the reduction in internal oxides and nitrides, and oxide stringers which extend into the specimen, after cyclic testing at 1,000° C. for about 410 cycles. The conventional purity specimen (FIG. 2*b;* 50 ppmw S) exhibits a significant amount of internal oxidation and oxide stringers, while the low sulfur specimen (FIG. 2*a;* 2 ppmw S) exhibits no internal oxides and no oxide stringers.

Tests have also shown that reducing the sulfur level in Ni-40Cr alloys dramatically reduces the amount of chromium oxide vaporization which occurs at elevated temperatures. As noted in the Background section, vaporization of chromium oxide reduces the amount of chromium which is available to form a chromium oxide scale, and therefore reduces the number of times the oxide scale can reform after it spalls from the surface. Tests have shown that by reducing the level of sulfur to below about 2 ppmw, vaporization of chromium oxide from a Ni-40Cr alloy is markedly decreased. In this test, Ni-Cr specimens containing about 2 ppmw and 50 ppmw sulfur were placed in individual high purity aluminum oxide crucibles. (These specimens were removed from the vacuum melted and homogenized samples discussed above.) The crucibles were then placed side by side and heated isothermally at 1,000° C. in an air atmosphere. At the completion of 400 hours, the samples were removed from their respective crucible, and each crucible usually examined. Along the bottom inside surface of the crucible which held the conventionl purity (50 ppmw S) specimen was a dark green deposit, indicating that some of the chromium oxide scale volatilized at elevated temperature exposure, and condensed on the walls of the crucible. The crucible which held the high purity (2 ppmw S) specimen exhibited no such deposits, and had the same white appearance as it had before the test was started. The reason that no volatilization took place on the high purity specimen is believed to be due to the fact that the chromium oxide scale which formed on the surface of the specimen during the isothermal exposure was very adherent, and stable. This phenomena is significant in that the nickel-chromium coatings of this invention are not only characterized by a more adherent chromium oxide scale, but also by a chromium metal reservoir which has long term stability.

Although this invention has been shown and described with respect to a preferred embodiment, it will be understood by those skilled in the art that various changes in form and detail thereof may be made without departing from the spirit and scope of the claimed invention.

I claim:

1. A coated high temperature turbine engine component, wherein the coating consists of, by weight, 10–50 chromium with the balance nickel, wherein the sulfur content in the coating is less than about 5 parts per million by weight.

2. The coated engine component of claim 1 wherein the sulfur content in the coating is less than about 2 parts per million by weight.

3. In a metal component suited for use at high temperatures and having a nickel-chromium coating thereon which consists essentially of, by weight percent, about 50–90 nickel, 10–50 chromium, and small amounts of impurities, the improvement which comprises an impurity level of sulfur in the coating of less than about 5 parts per million by weight.

4. The componenet of claim 3, wherein the coating consists essentially of about 70–55 nickel and 30–45 chromium.

* * * * *